US007722335B2

(12) United States Patent
Kim

(10) Patent No.: US 7,722,335 B2
(45) Date of Patent: May 25, 2010

(54) LINEAR COMPRESSOR

(75) Inventor: Jin Dong Kim, Kunpo-si (KR)

(73) Assignee: LG Electronics Inc., Seoul (KR)

( * ) Notice: Subject to any disclaimer, the term of this patent is extended or adjusted under 35 U.S.C. 154(b) by 913 days.

(21) Appl. No.: 11/221,809

(22) Filed: Sep. 9, 2005

(65) Prior Publication Data

US 2006/0251529 A1 Nov. 9, 2006

(30) Foreign Application Priority Data

May 6, 2005 (KR) ..... 10-2005-0037959

(51) Int. Cl.
*F04B 17/00* (2006.01)

(52) U.S. Cl. ..... 417/363; 248/638

(58) Field of Classification Search ..... 417/363; 292/50; 267/161, 33, 153, 166, 170, 174, 267/178; 248/618, 632, 638
See application file for complete search history.

(56) References Cited

U.S. PATENT DOCUMENTS 347,281 A * 8/1886 Vose ..... 267/33
1,911,866 A * 5/1933 Wylie ..... 267/269
2,158,418 A * 5/1939 Gits ..... 277/555
2,533,186 A * 12/1950 Bricker et al. ..... 188/73.41
3,128,999 A * 4/1964 Schmitt ..... 267/153
3,169,757 A * 2/1965 Roder et al. ..... 267/177
3,235,049 A * 2/1966 Hufstader ..... 192/89.23
3,784,779 A * 1/1974 Schaitberger ..... 219/78.02
5,090,657 A * 2/1992 Dreiman ..... 248/624
5,975,505 A * 11/1999 Yoshimoto et al. ..... 267/33
6,276,906 B1 * 8/2001 Noguchi ..... 417/363
2004/0033105 A1 * 2/2004 North ..... 403/408.1

FOREIGN PATENT DOCUMENTS

CN 1574569 A 2/2005
JP 2001-304120 A 10/2001
KR 10-2005-0040614 A 5/2005

* cited by examiner

*Primary Examiner*—Devon C Kramer
*Assistant Examiner*—Dnyanesh Kasture
(74) *Attorney, Agent, or Firm*—Birch, Stewart, Kolasch & Birch, LLP

(57) ABSTRACT

Disclosed herein is a linear compressor. The linear compressor comprises shell spring seats each including a shell coupling portion and a spring coupling portion. A buffer is provided between the shell coupling portion and the spring coupling portion to absorb vibration. This prevents the vibration from being transmitted from the spring coupling portion to the shell coupling portion, resulting in no noise discharge to the outside of the shell.

19 Claims, 4 Drawing Sheets

LINEAR COMPRESSOR

BACKGROUND OF THE INVENTION

1. Field of the Invention

The present invention relates to a linear compressor, and, more particularly, to a linear compressor in which a spring seat, for use in the fixation of a supporting spring, is provided with a buffer to prevent vibration generated in the spring seat from being transmitted to a shell, thereby eliminating noise discharge to the outside of the linear compressor.

2. Description of the Related Art

Generally, a linear compressor is an apparatus to suction and compress fluid, such as gaseous fluid (hereinafter, referred to as fluid) while linearly reciprocating a piston inside a cylinder using a linear driving force of a linear motor to thereby discharge the compressed fluid.

FIG. 1 is a longitudinal sectional view of a conventional linear compressor.

As shown in FIG. 1, the conventional linear compressor includes a shell 2, and a linear compression unit 4 arranged in the shell 2 to compress fluid.

A fluid suction pipe 6 is penetrated through one side of the shell 2, and a fluid discharge pipe 8 is also penetrated through the other side of the shell 2.

The linear compression unit 4 includes a cylinder block 12 centrally provided with a cylinder 10, a back cover 16 having a fluid suction port 14, a piston 18 inserted in the cylinder 10 to be linearly reciprocated inside the cylinder 10, a linear motor 20 to generate a driving force required to linearly reciprocate the piston 18 inside the cylinder 10, and a discharge unit 30 provided at a front side of the cylinder 10 to discharge compressed fluid from the cylinder 10.

The linear motor 20 is basically comprised of a stator and a mover. The stator includes an outer stator 21, an inner stator 22, a bobbin 23 mounted in the outer stator 21, and a coil 24 wound around the bobbin 23 to produce a magnetic field. The mover includes a magnet 25 to be linearly reciprocated using a magnetic force generated in the vicinity of the coil 24, and a magnet frame 26 to support the magnet 25 mounted thereon.

The piston 18 is affixed to the magnet frame 26 to receive a linear movement force of the magnet 25. The piston 18 is formed at a rear end thereof with a flange portion 28 to be affixed to a front surface of the magnet frame 26.

The linear compressor further comprises main springs to elastically support the piston 18 when the piston is linearly reciprocated. The main springs include a first main spring 34 interposed between the back cover 16 and a spring support 32 affixed to a rear surface of the magnet frame 26, and a second main spring 38 interposed between the spring support 32 and a stator cover 36 affixed to a rear end of the outer stator 21.

A plurality of supporting springs 40 are mounted between the shell 2 and the linear compression unit 4 to support the linear compression unit 4 in a shock-absorbing manner.

The supporting springs 40 include a first supporting spring 41 interposed between the cylinder block 12 and the shell 2, and a second supporting spring 42 interposed between the spring support 32 and the shell 2.

Each of the first and second supporting springs 41 and 42 has a first end fitted into a first spring seat 43 mounted at the shell 2, and a second end fitted into a second spring seat 44 mounted at the cylinder block 12 or spring support 32.

Now, operation of the conventional linear compressor configured as stated above will be explained.

First, when the linear motor 20 is operated, the magnet 25 is linearly reciprocated to transmit a linear reciprocating movement force to the piston 18 by way of the magnet frame 26. Thereby, the piston 18 is linearly reciprocated inside the cylinder 10.

According to the linear reciprocating movement of the piston 18, fluid present inside the shell 2 is introduced into the cylinder 10 through the fluid suction port 14 of the back cover 16 to thereby be compressed in the cylinder 10 by means of the piston 18. After that, the compressed fluid is discharged to the outside of the shell 2 through the discharge unit 30 and the discharge pipe 8.

In operation, the first and second supporting springs 41 and 42 serve to absorb vibration generated in the linear compression unit 4.

This prevents the vibration of the linear compression unit 4 from being transmitted to the shell 2, eliminating noise generation of the linear compressor.

However, in the case of the conventional linear compressor, since both ends of the supporting springs 40 are fitted into the first and second spring seats 43 and 44, it shows relative movement between the supporting springs 40 and the first and second spring seats 43 and 44 upon intensive operation of the linear compression unit 4, causing frictional vibration relative to each other. Consequently, the frictional vibration is transmitted to the shell 2, resulting in discharge of high-frequency noise to the outside of the linear compressor.

SUMMARY OF THE INVENTION

Therefore, the present invention has been made in view of the above problem, and it is an object of the present invention to provide a linear compressor capable of preventing vibration and noise due to relative movement between supporting springs and spring seats.

In accordance with a first aspect of the present invention, the above and other objects can be accomplished by the provision of a linear compressor comprising: a shell; a linear compression unit mounted in the shell to compress fluid using a linear driving force of a linear motor; a plurality of supporting springs provided between the shell and the linear compression unit to support the linear compression unit in a shock-absorbing manner; a plurality of spring seats configured to affix opposite ends of each supporting spring to the shell and the linear compression unit, respectively; and a plurality of buffers provided at part of the spring seats to absorb shock caused by relative movement between the spring seats and the supporting springs.

Preferably, the spring seats may include: shell spring seats provided at the shell to fix one end of each supporting spring; and compression unit spring seats provided at the linear compression unit to fix the other end of the supporting spring; and the buffers are provided at the shell spring seats, respectively, to absorb shock transmitted to the shell.

Preferably, each of the shell spring seats may include: a shell coupling portion coupled to the shell; and a spring coupling portion formed around an outer circumference of the shell coupling portion to be spaced apart from the shell coupling portion by a predetermined distance, the spring coupling portion being coupled to the supporting spring.

Preferably, each of the buffers may be interposed between the shell coupling portion and the spring coupling portion of each shell spring seat, and is adapted to absorb shock transmitted from the spring coupling portion to the shell coupling portion.

Preferably, the buffer may include: a cylindrical portion configured to be fitted to an outer circumference of the shell coupling portion; and a flange portion protruding radially from a lower end of the cylindrical portion to come into contact with the shell.

Preferably, the cylindrical portion may be provided at an upper end thereof with a radially protruding second holding portion to prevent separation of the spring coupling portion.

Preferably, the buffer may be a plate spring assembly having a ring shape to be fitted to the outer circumference of the shell coupling portion.

Preferably, the plate spring assembly may include: a lower plate spring disposed at the lower end of the shell coupling portion to elastically support a lower end of the spring coupling portion; and an upper plate spring disposed at the upper end of the shell coupling portion to elastically support an upper end of the spring coupling portion.

Preferably, the lower or upper plate spring may include: a lower or upper first conical portion having an inclination suitable to absorb the vertical vibration of the spring coupling portion; and a lower or upper second conical portion bent from an inner circumference of the lower or upper first conical portion and having an inclination suitable to absorb horizontal vibration of the spring coupling portion.

Preferably, the shell coupling portion may be provided at the upper end thereof with a first holding portion to prevent both the buffer and the spring coupling portion from being separated upwardly from the shell coupling portion.

The linear compressor according to the present invention is configured such that each shell spring seat includes the shell coupling portion and the spring coupling portion, and the buffer is interposed between the shell coupling portion and the spring coupling portion to absorb vibration, thereby preventing vibration from being transmitted from the spring coupling portion to the shell coupling portion. This consequently prevents noise discharge to the outside of the shell.

Further, the buffer is fitted around the outer circumference of the shell coupling portion, and in turn, the spring coupling portion is fitted around the outer circumference of the buffer. This simplified structure facilitates assembly of the buffer.

Furthermore, with the use of the compressed holding portion formed at the upper end of the shell coupling portion, there is no risk of separation of the buffer and the spring coupling portion from the shell coupling portion.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described with reference to the accompanying drawings.

Figure 1:
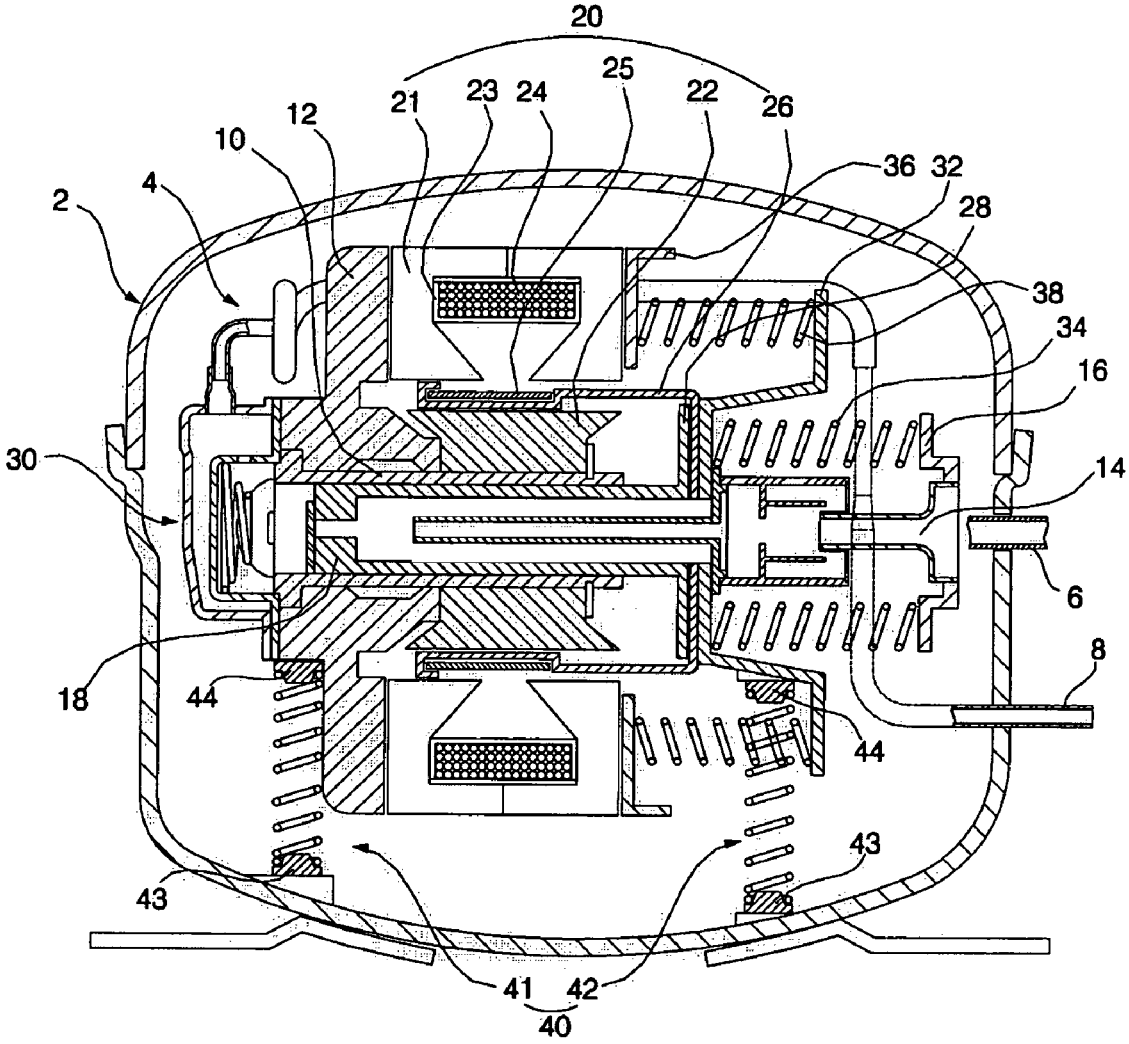
FIG. 1 (Prior Art)
FIG. 1 is a longitudinal sectional view of a conventional linear compressor.
Figure 2:
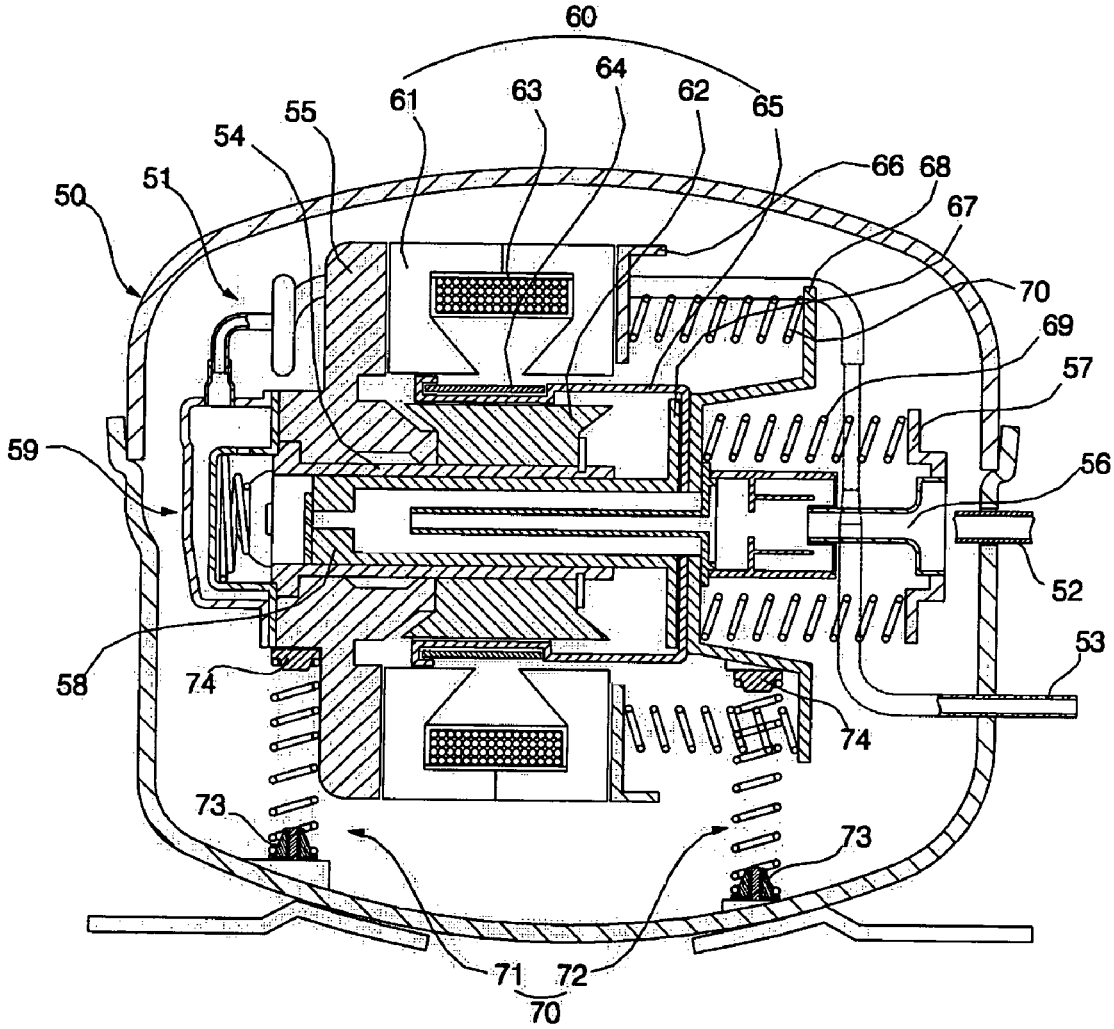
FIG. 2 is a longitudinal sectional view illustrating a linear compressor according to a first embodiment of the present invention.
Figure 3:
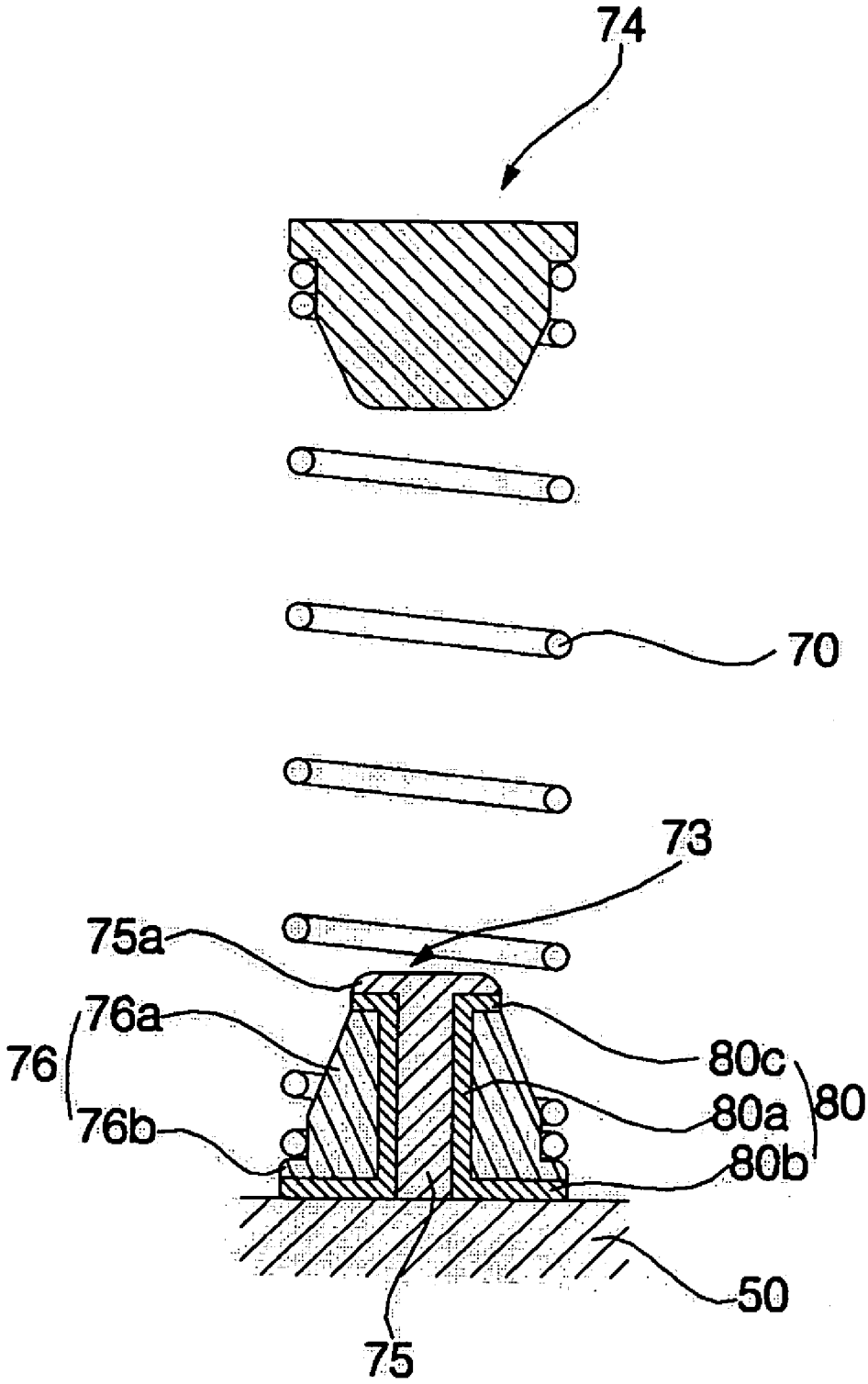
FIG. 3 is an enlarged sectional view illustrating a spring seat of the linear compressor according to the first embodiment of the present invention.

FIG. 2 is a longitudinal sectional view illustrating a linear compressor according to a first embodiment of the present invention. FIG. 3 is an enlarged sectional view illustrating a spring seat of the linear compressor according to the first embodiment of the present invention.

As shown in FIGS. 2 and 3, the linear compressor according to the first embodiment of the present invention comprises a shell 50, and a linear compression unit 51 mounted in the shell 50 and adapted to compress fluid using a linear driving force from a linear motor 60.

A fluid suction pipe 52 is penetrated through one side of the shell 50, and a fluid discharge pipe 53 is also penetrated through the other side of the shell 50.

The linear compression unit 51 includes a cylinder block 55 centrally provided with a cylinder 54, a back cover 57 having a fluid suction port 56 positioned to face the suction pipe 52, a piston 58 inserted in the cylinder 54 to be linearly reciprocated inside the cylinder 54, the linear motor 60 to generate a driving force required to linearly reciprocate the piston 58 inside the cylinder 54, and a discharge unit 59 provided at a front side of the cylinder 54 to discharge compressed fluid from the cylinder 54.

The linear motor 60 is basically comprised of a stator and a mover. The stator includes an outer stator 61, an inner stator 62, and a coil 63 to produce a magnetic field. The mover includes a magnet 64 to linearly reciprocate using a magnetic force generated in the vicinity of the coil 63, and a magnet frame 65 to support the magnet 64 mounted thereon.

Here, a stator cover 66 is affixed to the outer stator 61.

The piston 58 is affixed to the magnet frame 65 to receive a linear movement force of the magnet 64. For this, the piston 18 is formed at a rear end thereof with a flange portion 67 to be affixed to a front surface of the magnet frame 65. To a rear surface of the magnet frame 65 is coupled a spring support 68, which cooperates with the piston 58.

The spring support 68 is provided with a plurality of main springs to elastically support the piston 58 upon reciprocation of the piston 58.

The linear compressor further comprises a plurality of supporting springs 70 mounted between the shell 50 and the linear compression unit 51 to support the linear compression unit 51 in a shock-absorbing manner, spring seats to affix both ends of each supporting spring 70 to both the shell 50 and the linear compression unit 51, and buffers 80 provided at some of the spring seats to absorb vibration caused by relative movement between the spring seats and the supporting springs 70.

The plurality of supporting springs 70 include a first supporting spring 71 interposed between the cylinder block 55 and the shell 50, and a second supporting spring 72 interposed between the spring support 68 and the shell 50.

The spring seats include shell spring seats 73 provided at the shell 50 to fix one end of each supporting spring 70, respectively, and compression unit spring seats 74 provided at the linear compression unit 51 to fix the other end of the supporting spring 70, respectively.

Specifically, the compression unit spring seats 74 are provided at the cylinder block 55 or spring support 68.

Meanwhile, the buffers 80 are provided at the respective shell spring seats 73 to absorb vibration transmitted from the shell spring seats 73 to the shell 50.

As shown in FIG. 3, each of the shell spring seats 73 includes a shell coupling portion 75 coupled to the shell 50, and a spring coupling portion 76 formed around an outer circumference of the shell coupling portion 75 to be spaced apart therefrom by a predetermined distance. The spring coupling portion 76 is coupled to one of the supporting springs 70.

The shell coupling portion 75 has a cylindrical shape, and is affixed at a lower end thereof to the shell 50 by welding or adhesion.

The spring coupling portion 75 is divided into a fitting portion 76*a* configured to face the outer circumference of the shell coupling portion 75 to be fitted to an inner circumference of the supporting spring 70, and a seating portion 76*b* protruding radially from a lower end of the fitting portion 76*a* to support an end of the supporting spring 70 placed thereon.

Each buffer 80 is interposed between the shell coupling portion 75 and the spring coupling portion 76 to absorb shock generated therebetween.

The buffer 80 includes a cylindrical portion 80*a* configured to be fitted to the outer circumference of the shell coupling portion 75, and a flange portion 80*b* protruding radially from an end of the cylindrical portion 80*a* to come into contact with the shell 50.

The spring coupling portion 76 is fitted to an outer circumference of the cylindrical portion 80*a* so that it is seated at an upper surface of the flange portion 80*b* rather than coming into direct contact with the shell 50.

The buffer 80 is preferably made of an elastic material, such as rubber.

The shell coupling portion 75 is provided with a first holding portion 75*a* to prevent both the buffer 80 and the spring coupling portion 76 from being separated upwardly from the shell coupling portion 75.

That is, the first holding portion 75*a* protrudes radially from an upper end of the shell coupling portion 75.

The first holding portion 75*a* is formed by compressing the upper end of the shell coupling portion 75 after the buffer 80 and the spring coupling portion 76 are fitted around the shell coupling portion 75.

Upon compression of the first holding portion 75*a*, an upper end of the cylindrical portion 80*a* is simultaneously compressed, forming a radially protruding second holding portion 80*c* which serves to prevent upward separation of the spring coupling portion 76.

Now, the operation of the linear compressor according to the first embodiment of the present invention configured as stated above will be explained.

First, if the linear motor 60 is driven, the magnet 64 is linearly reciprocated. As the linear reciprocating movement of the magnet 64 is transmitted to the piston 58 via the magnet frame 65, causing the piston 58 to linearly reciprocate inside the cylinder 54.

According to the linear reciprocating movement of the piston 58, fluid inside the shell 50 is introduced into the cylinder 54 through the fluid suction port 56 of the back cover 57 to thereby be compressed in the cylinder 54 by means of the piston 58. The resulting compressed fluid is discharged to the outside of the shell 50 through the discharge unit 58 and the discharge pipe 53.

Meanwhile, vibration generated in the linear compression unit 51 is absorbed by the supporting springs 70.

If excess vibration is generated in the linear compression unit 51, relative movement is inevitably generated between the supporting springs 70 and the spring coupling portions 76 to thereby generate frictional vibration. However, according to the present invention, the buffers 80 effectively absorb the vibration, thereby preventing the vibration from being transmitted from the spring coupling portions 76 to the shell coupling portions 75.

This consequently prevents the vibration from being transmitted to the shell 50 via the shell coupling portions 75, resulting in no noise discharge to the outside of the linear compressor.

Figure 4:
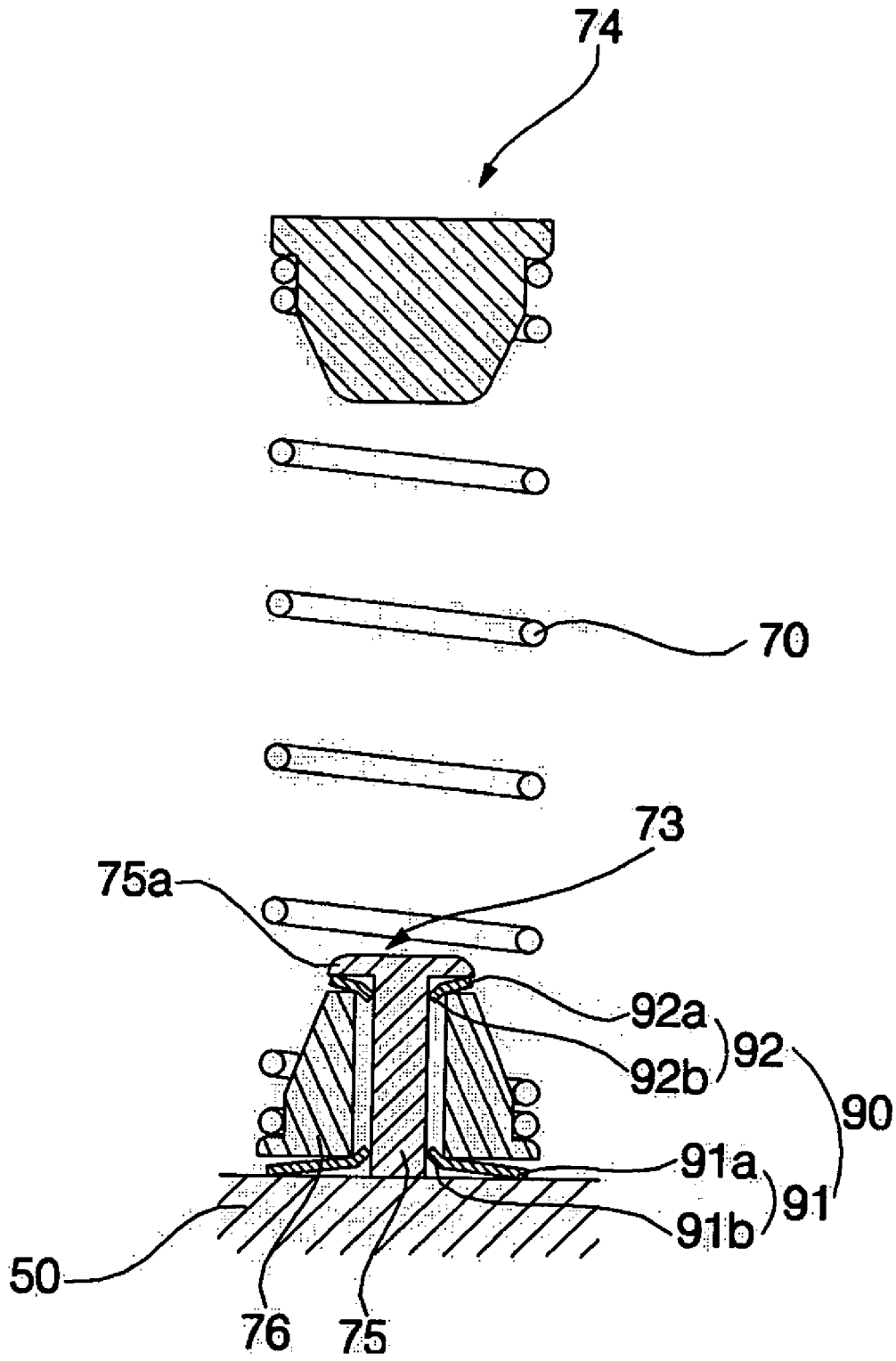
FIG. 4 is an enlarged sectional view illustrating a spring seat of the linear compressor according to a second embodiment of the present invention.

FIG. 4 is an enlarged sectional view illustrating a spring seat of the linear compressor according to a second embodiment of the present invention.

The linear compressor according to the second embodiment of the present invention is similar to that of the first embodiment in general configuration and operation except that each buffer, fitted to the outer circumference of one of the shell coupling portions 75, takes the form of a plate spring assembly 90 having a ring shape. Thus, a detailed description of the linear compressor according to the present embodiment will be omitted, and the same reference numerals are used to denote identical parts.

Each plate spring assembly 90 includes a lower plate spring 91 disposed at a lower end of the shell coupling portion 75 to elastically support a lower end of the spring coupling portion 76, and an upper plate spring 92 disposed at an upper end of the shell coupling portion 75 to elastically support an upper end of the spring coupling portion 76.

The lower plate spring 91 has a lower first conical portion 91*a* having an inclination suitable to absorb vertical vibration of the spring coupling portion 76, and a lower second conical portion 91*b* bent from an inner circumference of the lower first conical portion 91*a* and having an inclination suitable to absorb horizontal vibration of the spring coupling portion 76.

The lower first conical portion 91*a* is located between the lower end of the spring coupling portion 76 and the shell 50, and the lower second conical portion 91*b* is located between the inner circumference of the spring coupling portion 76 and the outer circumference of the shell coupling portion 75.

The upper plate spring 92 has an upper first conical portion 92*a* having an inclination suitable to absorb vertical vibration of the spring coupling portion 76, and an upper second conical portion 92*b* bent from an inner circumference of the upper first conical portion 92*a* and having an inclination suitable to absorb horizontal vibration of the spring coupling portion 76.

The upper first conical portion 92*a* is located between the holding portion 75*a* of the shell coupling portion 75 and an upper end of the spring coupling portion 76, and the upper second conical portion 92*b* is located between the inner circumference of the spring coupling portion 76 and the outer circumference of the shell coupling portion 75.

As is apparent from the above description, the linear compressor according to the present invention configured as stated above has the following effects.

Firstly, the linear compressor according to the present invention is configured such that each shell spring seat includes a shell coupling portion and a spring coupling portion, and a buffer is interposed between the shell coupling portion and the spring coupling portion to absorb vibration, thereby preventing vibration from being transmitted from the spring coupling portion to the shell coupling portion. This consequently prevents noise discharge to the outside of the shell.

Secondly, according to the present invention, a buffer is fitted around the outer circumference of the shell coupling portion, and in turn, the spring coupling portion is fitted around the outer circumference of the buffer. This simplified structure facilitates assembly of the buffer.

Thirdly, with the use of a compressed holding portion formed at an upper end of the shell coupling portion, there is no risk of separation of the buffer and the spring coupling portion from the shell coupling portion.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A linear compressor comprising:

a shell;

a linear compression unit mounted in the shell to compress fluid using a linear driving force of a linear motor;

a plurality of supporting springs provided between the shell and the linear compression unit to support the linear compression unit in a shock-absorbing manner;

a plurality of spring seats configured to affix opposite ends of each supporting spring to the shell and the linear compression unit, respectively, the spring seats including a shell spring seat provided at the shell;

the shell spring seat including:

a shell coupling portion immovably coupled to the shell;

a spring coupling portion formed around an outer circumference of the shell coupling portion and spaced apart from the shell coupling portion by a predetermined distance, the spring coupling portion being coupled to the supporting spring; and a buffer interposed between the shell coupling portion and the spring coupling portion of each shell spring seat adapted to absorb shock transmitted from the spring coupling portion to the shell coupling portion.

2. The compressor as set forth in claim 1, wherein the spring seats include:

compression unit spring seats provided at the linear compression unit to fix an end of the supporting spring.

3. The compressor as set forth in claim 1, wherein the shell coupling portion has a cylindrical shape, and is affixed at a lower end thereof to an inner surface of the shell.

4. The compressor as set forth in claim 1, wherein the buffer includes:

a cylindrical portion configured to be fitted to an outer circumference of the shell coupling portion; and a flange portion protruding radially from a lower end of the cylindrical portion to come into contact with the shell.

5. The compressor as set forth in claim 4, wherein the shell coupling portion is provided at an upper end thereof with a first holding portion to prevent both the buffer and the spring coupling portion from being separated upwardly from the shell coupling portion.

6. The compressor as set forth in claim 5, wherein the first holding portion is formed by compressing the upper end of the shell coupling portion after the buffer and the spring coupling portion are fitted around the shell coupling portion.

7. The compressor as set forth in claim 6, wherein the cylindrical portion is provided at an upper end thereof with a radially protruding second holding portion to prevent separation of the spring coupling portion.

8. The compressor as set forth in claim 1, wherein the linear compression unit includes:

a cylinder block provided with a cylinder;

a back cover having a fluid suction port;

a piston inserted in the cylinder to linearly reciprocate inside the cylinder;

the linear motor to generate a driving force required to linearly reciprocate the piston inside the cylinder; and a discharge unit to discharge compressed fluid from the cylinder.

9. The compressor as set forth in claim 8, further comprising:

a spring support provided with a plurality of main springs which provide an elastic force to the piston upon reciprocation of the piston.

10. The compressor as set forth in claim 1, wherein the buffer is a plate spring assembly having a ring shape to be fitted to the outer circumference of the shell coupling portion.

11. The compressor as set forth in claim 10, wherein the plate spring assembly includes:

a lower plate spring disposed at the lower end of the shell coupling portion to elastically support a lower end of the spring coupling portion; and an upper plate spring disposed at the upper end of the shell coupling portion to elastically support an upper end of the spring coupling portion.

12. The compressor as set forth in claim 11, wherein the upper or lower plate spring includes:

an upper or lower first conical portion having an inclination suitable to absorb the vertical vibration of the spring coupling portion; and an upper or lower second conical portion bent from an inner circumference of the upper or lower first conical portion and having an inclination suitable to absorb horizontal vibration of the spring coupling portion.

13. The compressor as set forth in claim 12, wherein the shell coupling portion is provided at the upper end thereof with the first holding portion to prevent both the buffer and the spring coupling portion from being separated upwardly from the shell coupling portion.

14. The compressor as set forth in claim 13, wherein the first holding portion is formed by compressing the upper end of the shell coupling portion after the buffer and the spring coupling portion are fitted around the shell coupling portion.

15. The compressor as set forth in claim 1, wherein the spring coupling portion has an inner circumference spaced apart from the outer circumference of the shell coupling portion by the predetermined distance.

16. The compressor as set forth in claim 1, wherein the buffer comprises a cylindrical portion and a radially protruding second portion.

17. A linear compressor comprising:

a shell;

a linear compression unit mounted in the shell to compress fluid using a linear driving force of a linear motor;

a plurality of supporting springs provided between the shell and the linear compression unit to support the linear compression unit in a shock-absorbing manner;

a shell spring seat provided at the shell to fix an end of a supporting spring;

a compression unit spring seat provided at the linear compression unit to fix the other end of the supporting spring; and a plate spring assembly provided at the shell spring seat to absorb shock transmitted to the shell;

the shell spring seat including:

a shell coupling portion immovably coupled to the shell; and a spring coupling portion formed around an outer circumference of the shell coupling portion and spaced apart from the shell coupling portion by a predetermined distance, the spring coupling portion being coupled to the supporting spring, wherein a plate spring assembly is interposed between the shell coupling portion and the spring coupling portion.

18. The compressor as set forth in claim 17, wherein the spring coupling portion has an inner circumference spaced apart from the outer circumference of the shell coupling portion by the predetermined distance.

19. A linear compressor comprising:

a shell;

a linear compression unit mounted in the shell to compress fluid using a linear driving force of a linear motor;

a plurality of supporting springs provided between the shell and the linear compression unit to support the linear compression unit in a shock-absorbing manner;

a plurality of spring seats configured to affix opposite ends of each supporting spring to the shell and the linear compression unit, respectively, the spring seats including shell spring seats provided at the shell;

each of the shell spring seats including:

a shell coupling portion coupled to the shell, the shell coupling portion not extending through the shell;

a spring coupling portion formed around an outer circumference of the shell coupling portion and spaced apart from the shell coupling portion by a predetermined distance, the spring coupling portion being coupled to the supporting spring; and a buffer interposed between the shell coupling portion and the spring coupling portion of each shell spring seat, adapted to absorb shock transmitted from the spring coupling portion to the shell coupling portion.

* * * * *